United States Patent [19]

Fukunaga et al.

[11] 4,223,531

[45] Sep. 23, 1980

[54] GAS PRESSURE TO HYDRAULIC PRESSURE CONVERTER SYSTEM IN AN OIL PRESSURE ACTUATOR

[75] Inventors: Akio Fukunaga, Kakogawa; Toshio Nakane, Akashi, both of Japan

[73] Assignee: Kobe Steel, Limited, Kobe, Japan

[21] Appl. No.: 26,546

[22] Filed: Apr. 3, 1979

[30] Foreign Application Priority Data

Apr. 3, 1978 [JP] Japan ..... 53-39531

[51] Int. Cl.[3] ..... F15B 1/02

[52] U.S. Cl. ..... 60/400; 60/403; 91/4 R

[58] Field of Search ..... 91/4 R; 60/400, 416, 60/403

[56] References Cited

U.S. PATENT DOCUMENTS

| | | | |
|---|---|---|---|
| 2,791,093 | 5/1957 | Shafer | 60/400 |
| 2,849,987 | 9/1958 | Shafer | 91/461 |
| 2,896,582 | 7/1959 | Justice | 91/407 |
| 3,055,345 | 9/1962 | Johnson | 91/420 |
| 3,069,855 | 12/1962 | Denkowski et al. | 60/400 |
| 3,276,330 | 10/1966 | Johnson | 91/4 R |
| 3,507,189 | 4/1970 | Beckett | 91/4 R |
| 3,653,635 | 4/1972 | Bates | 91/4 R |
| 3,802,318 | 4/1974 | Sibbald | 91/4 R |
| 4,102,128 | 7/1978 | Shafer | 60/400 |

*Primary Examiner*—Edgar W. Geoghegan
*Attorney, Agent, or Firm*—Oblon, Fisher, Spivak, McClelland & Maier

[57] ABSTRACT

A device of the type wherein a gas pressure is converted into an oil pressure and the resulting oil pressure is exerted to drive an actuator. A pair of gas-oil reservoirs are coupled with each other via a conduit wherein an automatic oil level control valve is disposed to close the conduit when the actuator is in operation and the gas pressure in the reservoirs are not balanced and open the conduit when the actuator is not in operation.

4 Claims, 4 Drawing Figures

GAS PRESSURE TO HYDRAULIC PRESSURE CONVERTER SYSTEM IN AN OIL PRESSURE ACTUATOR

BACKGROUND OF THE INVENTION

1. Field of the Invention

The present invention relates to a gas pressure-to-hydraulic (hereinafter referred to as oil) pressure converter system in an oil pressure actuator, which converts a gas pressure into an oil pressure to drive the actuator and thus a functional subject such as a valve.

2. Description of the Prior Art

It is well known in a wide range of industrial fields that this type of a gas pressure-to-oil pressure converter is utilized to drive an actuator. By way of an oil pipe line system, the above-described type of the actuator drive system is conventionally employed to actuate a ball valve or a gate valve disposed in a particular position in the pipe line.

As viewed from an exemplary pipe line system of FIG. 1, an actuator 3 is provided for a ball valve or a gate valve 2 which is intended for actuation and disposed in a particular point in a pipe line. The inner gas pressure of the pipe line 1 is stored within a power storage reservoir 4 for a while and then the gas pressure of the reservoir 4 is exerted on one part of gas-oil reservoirs 6, 7 for conversion into an oil pressure upon actuation of the control valve 5. Application of such an oil pressure onto the actuator 3 via a hand pump 8, therefore, permits the actuator 3 to operate the ball valve or gate valve 2.

With the above described actuator drive mechanism, oil tends to somewhat leak out from an oil cylinder section of the actuator 3, the hand pump 8 and so on and oil, for example, moves from the one gas-oil reservoir 6 to the other 7, deteriorating the normal performance of the drive mechanism. This results in a substantial change in the speed of valve opening and closing and eventually causes serious problems in the pipe line service used with the pipe line.

SUMMARY OF THE INVENTION

It is therefore an object of the present invention to overcome the prior art problem, that is, eliminate an offset in oil level between gas-oil reservoirs.

A further object of the present invention is to provide a new gas pressure-to-oil pressure converter which automatically controls oil levels within a pair of gas-oil reservoirs while not in operation and which achieves a normal performance while in operation, without any offset of oil at either of the reservoirs.

In one basic aspect of the gas pressure-to-oil pressure converter embodying the present invention, a pair of gas-oil reservoirs are coupled via a conduit at their upper portions with each other. An automatic oil level control valve is disposed in a particular position in the conduit to shut off the conduit when the gas pressure of one of the reservoirs is higher than the other and open the same when the gas pressures are both equal. While the actuator is not in operation, the automatic oil level control valve serves to maintain the oil levels between the gas-oil reservoirs in the predetermined relationship.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

DETAILED DESCRIPTION OF THE PREFERRED EMBODIMENTS

Figure 1:
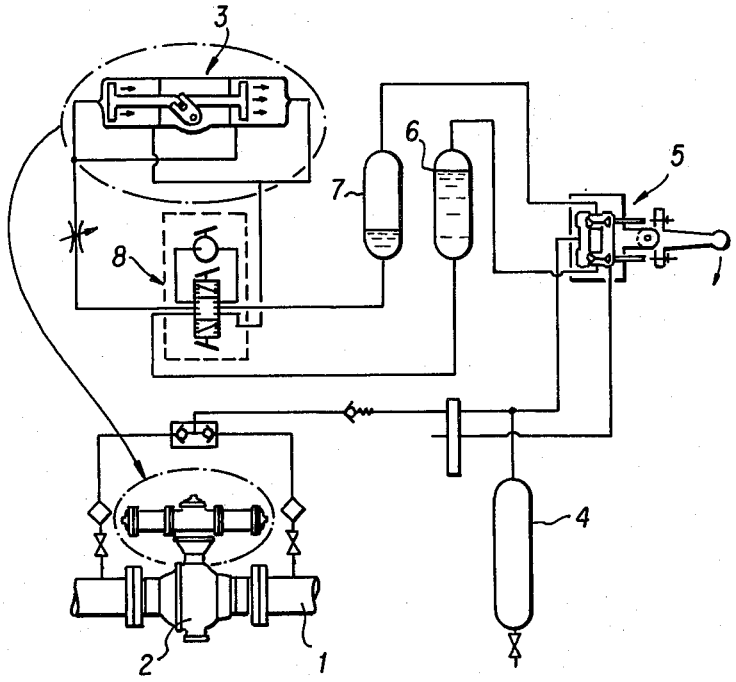
FIG. 1 PRIOR ART
FIG. 1 is a schematic diagram of a prior art actuator drive mechanism.
Figure 2:
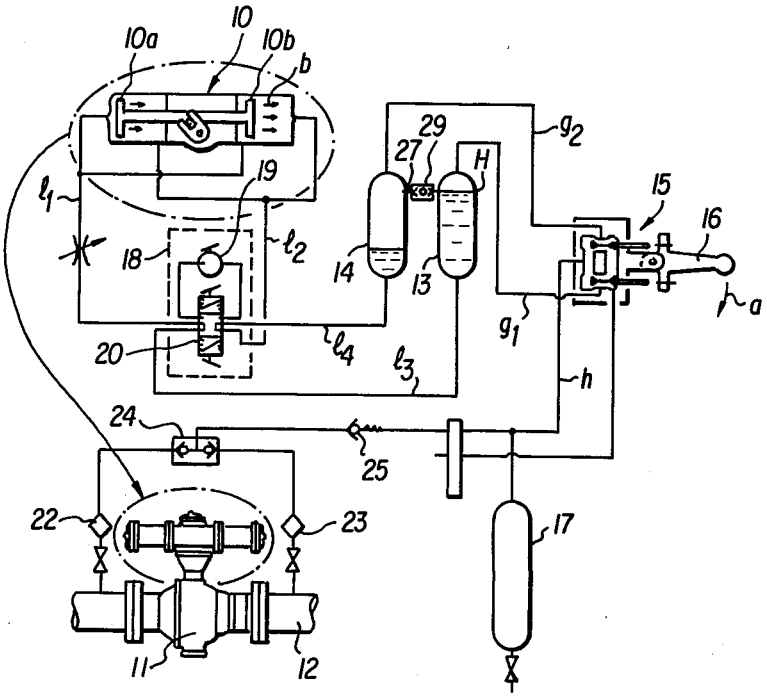
FIG. 2 is a schematic diagram of an actuator drive mechanism embodying the principles of the present invention in its preferred form.

Referring now to FIG. 2, there is illustrated one embodiment of the present invention constructed in the field of the pipe line system as well. An actuator 10 is adapted such that one piston 10*a* moves to the right side of the drawings when oil is supplied via an oil supply pipe $l_1$ and another piston 106 moves to the left side when oil is supplied via an oil supply pipe $l_2$. An objective subject which the actuator 10 intends to operate is, for example, a ball valve or a gate valve. A pair of gas-oil reservoirs 13, 14 are adapted to convert a gas pressure into an oil pressure by the effect of oil containing such gas pressure. A control valve 15 connects any one of gas supply lines $g_1$, $g_2$ leading from the respective gas-oil reservoirs 13, 14 to a gas supply line h leading to a power reservoir 17 upon actuation of a manual handle 16. An auxiliary drive mechanism 18 is provided for the actuator, which includes a hand pump 19 and directional control valve 20 for the purpose of operating the actuator 10 in the event that there is no gas pressure in the power reservoir 17 and pipe line h. The directional control valve 20 normally stands in a neutral position, connecting an oil supply line $l_3$ carrying the oil pressure of the first gas-oil reservoir 13 to the first oil supply line $l_1$ and an oil supply line $l_4$ carrying the counterpart of the second gas-oil reservoir 14 to the second oil supply line $l_2$, respectively.

The gas pressure is supplied via a pair of strainers 22, 23 communicating with the pipe line 12 fore and aft, the ball valve or the gate valve 11 and then introduced into the power reservoir 17 via a double check valve 24 and a check valve 25.

The first and second gas-oil reservoirs 13, 14 are connected via a conduit 27 to each at the position H corresponding to the maximum oil level (denoted by an oil level in the first gas-oil reservoir 13 in the illustration). An automatic oil level control valve 29 is provided in a particular position in the conduit 27 so as to open the conduit 27 when the gas pressures of the first and second gas-oil reservoirs 13, 14 are equal and close the conduit 27 to cut off connection between the two reservoirs 13, 14, for example, when the gas pressure in the first gas-oil reservoir 13 is higher than that in the second reservoir 14.

Figure 3:
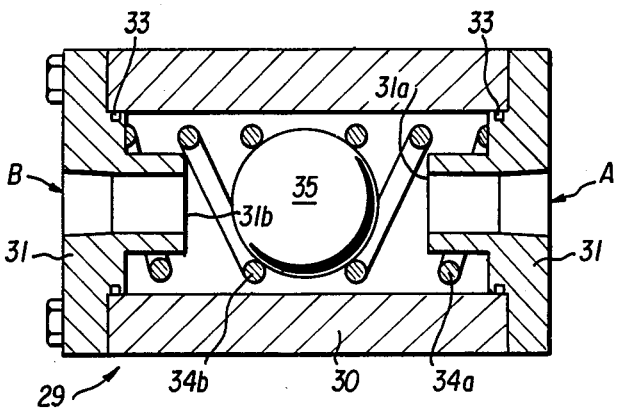
FIG. 3 is a cross-sectional view of an example of the automatic oil level control valve used with the present invention.

As seen from FIG. 3, the automatic oil level control valve 29 is adapted such that end plates with valve seats 31*a*, 31*b* extending inwardly from connection ports A, B are fastened to both ends of a cylindrical tube 30 by means of bolts, etc.. "O" rings 33 are located around shoulders of the end plates 31 to establish a seal between the tube 30 and the end plates 31, completing a valve body. A valve assembly is received between the end plates 31 such that a ball or poppet 35 is normally urged into a neutral position by the action of a pair of coil springs 34.

Figure 4:
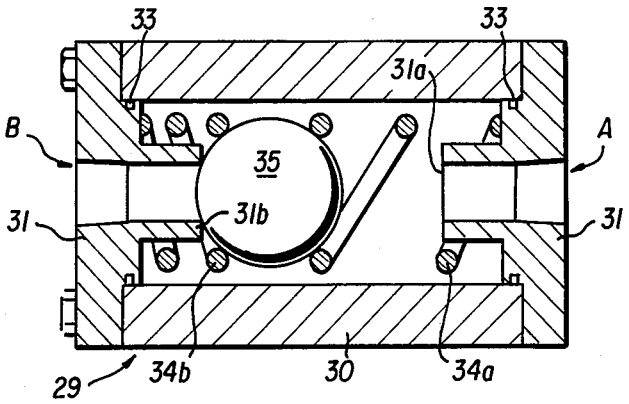
FIG. 4 is a cross-sectional view of the valve of FIG. 3 in operation.

Assuming now that the pressure at the side of the connection port A is higher than at the side of the port B, as viewed from FIG. 4, gas will flow under pressure from reservoir 13, through port A and past ball 35 toward port B. The drag on the ball or poppet 35 caused by the flow pressure causes the ball to be shifted to the left side port B against the tension of the one coil spring 34*b*, closing the valve seat 31 at the port B and shutting off the path between the ports A, B.

As stated above, in the case where the first and second gas-oil reservoirs 13, 14 are connected via the conduit 27 in the respective maximum oil level positions and the automatic oil level control valve 29 is located within the conduit 27, the reservoirs 13, 14 are isolated from each other to ensure the performance of the actuator 10 while the actuator 10 is in operation. On the other hand, when the control valve is restored to the neutral position to render the actuator non-operable, the oil levels of the two reservoirs 13, 14 are automatically controlled.

For example, if the manual handle 16 of the control valve 15 is turned in the direction of the arrow a, then the gas supply line h extending from the power reservoir 17 will be connected to the gas supply line $g_1$ leading to the first gas-oil reservoir 13 so that the higher gas pressure is transferred from the power reservoir 17 to the first gas-oil reservoir 13, effecting closing of valve 35 as previously described. Accordingly, the oil within the first gas-oil reservoir 13 declines progressively from the maximum level H, permitting oil to be supplied to the first oil supply line $l_1$ through the third oil supply line $l_3$ and the directional control valve 20 under a desired pressure. The piston 10*a* in the actuator 10 moves rightward as denoted by the arrow b to thereby drive the actuator 10 for opening or closing the ball valve or the gate valve 11.

Upon the rightward movement of the piston 10*a*, oil is returned to the second gas-oil reservoir 14 via the directional control valve 20, recovering progressively the oil level in the second gas-oil reservoir 14. When completing a full stroke of the rightward movement of the piston 10*a*, the oil level in the second gas-oil reservoir 14 reaches a maximum level H while the oil level in the first reservoir 13 becomes lower unlike that in FIG. 2.

When the control valve 15 is back in the neutral position, supply of the higher gas pressure from the power reservoir 17 is inhibited so that the gas pressure in the first gas-oil reservoir 13 is fed to the gas supply line $g_1$ and to the control valve 15 for removal to the surrounding atmosphere. Under this circumstance, the gas pressure in the first gas-oil reservoir 13 falls and the gas pressures in the first and second gas-oil reservoirs 13, 14 become equal to the atmospheric pressure. By equalizing the gas pressures in the two reservoirs 13, 14, the automatic oil level control valve 29 changes the conduit 27 from the closed state to the open state. The two reservoirs 13, 14 are held in an open relationship until the control valve 15 is actuated again. If the oil level exceeds the maximum H during the course of the previous rightward movement, this connection will lower automatically the level to the maximum H.

As noted earlier, while the actuator 10 is in operation, the first and second gas-oil reservoirs 13, 14 are coupled via the automatic oil level control valve 29 to control automatically the oil level below the maximum and eliminate an offset of the oil level in the oil reservoirs.

It will be noted that a volume requirement of the gas-oil reservoirs 13, 14 is reduced to a minimum by connecting the reservoirs 13, 14 at the maximum oil level H through the conduit 27 containing the automatic oil level control valve 29. Since the object of the automatic oil level control valve 29 is to act on an oil level which is higher than the location of the automatic oil level control valve 29, only a minimum amount of oil for actuation of the actuator 10 should be provided within the gas-oil reservoirs to reduce the amount of oil and the volume of the reservoirs to a minimum provided that the location of the automatic oil level control valve 29 is flush with the maximum oil level H.

It is, however, obvious that the present invention is applicable to not only when the mechanism is adapted to minimize the reservoir volume and the oil amount as set forth above but also when the conduit 27 is located in a position other than the maximum oil level H together with the automatic oil level control valve 29.

While in the above embodiment the actuator drive mechanism within the pipe line system has been illustrated and disclosed, the present invention is not to be limited to such an embodiment. It is also apparent that the objective subject intended for actuation is not limited to valves such as a ball valve and a gate valve and the automatic oil level control valve may take various forms. In summary, various changes and modifications may be made without departing from the scope and spirit of this invention.

As stated above, the present invention is characterized in a gas pressure-to-oil pressure converter in an oil pressure type actuator wherein a pair of the gas-oil reservoirs are connected to each other at their upper portion via a conduit and an automatic oil level control valve is provided at a particular point in the conduit in a manner to shut off the conduit when the actuator is in operation and the gas pressure in one of the reservoirs is higher than that in another and open the conduit when the actuator is not in operation and the gas pressures in the two reservoirs are identical.

Therefore, the present invention makes it possible to equalize the gas pressures in the gas-oil reservoirs during the non-operational state of the actuator, maintain the oil level at or below the maximum position at all times, and eliminate an offset of the oil in any one of the gas-oil reservoirs. This guarantees accurate performance and simplicity in construction within the actuator drive mechanism.

What is claimed as new and desired to be secured by Letters Patent of the United States is:

1. In a gas pressure to hydraulic pressure converter system for use in powering an actuator, wherein a means for supplying pressurized gas is connected with control valve means to control supply and exhaust of pressurized gas to and from first and second gas-to-hydraulic reservoirs partially filled with hydraulic fluid and each being connected with the actuator to operate the actuator in respectively opposite directions when gas pressure is supplied to a respective one of the reservoirs by appropriate operation of the control valve means, the improvement comprising:

a conduit connected between the reservoirs at the location of desired maximum hydraulic fluid level therein;

a valve body connected at opposite ends thereof in the conduit and having a valve seat at each end thereof;

a valve member reciprocable in the body between the seats; and biasing means urging the valve member to a neutral position between and spaced from the seats, the valve member being movable toward one reservoir and into contact with one of the seats when pressure in the other reservoir exceeds the force of the biasing means to thus prevent loss of pressure from one reservoir to the other during actuation, and the valve member assuming its neutral position when gas pressure between the reservoirs is equal to enable flow of hydraulic fluid from one reservoir to the other when the level of hydraulic fluid in said one reservoir reaches the predetermined maximum level.

2. The gas pressure to hydraulic converter system as set forth in claim 1, wherein:

the control valve means includes a first output port and a second output port and, wherein the control valve acts to direct gas pressure to one of said output ports while simultaneously exhausting the other of said output ports to atomosphere, the first gas-to-hydraulic reservoir being in fluid communication with said first output port and the second gas-to-hydraulic reservoir being in fluid communication with the second output port.

3. The gas pressure to hydraulic converter system as set forth in claim 1, wherein:

the valve member comprises a ball valve; and the biasing means comprises a pair of coil springs engaged with opposite sides of the ball valve.

4. The gas pressure to hydraulic pressure converter system as set forth in claim 1 further comprising:

an auxiliary drive mechanism interposed between and in fluid flow communication with said reservoirs and said actuator, wherein said auxiliary drive mechanism comprises:

a hand pump for manually supplying hydraulic pressure to said actuator; and a directional control valve which selects between hydraulic pressure supplied by said reservoirs and hydraulic pressure supplied by said hand pump.

* * * * *